US005202531A

United States Patent [19]

Månsson et al.

[11] Patent Number: 5,202,531

[45] Date of Patent: Apr. 13, 1993

[54] RAMMER

[75] Inventors: Stig Månsson; Lars Månsson, both of Karlskoga, Sweden

[73] Assignee: Swedish Ordnance FFV/Bofors AB, Karlskoga, Sweden

[21] Appl. No.: 777,374

[22] PCT Filed: May 30, 1990

[86] PCT No.: PCT/SE90/00365

§ 371 Date: Feb. 3, 1992

§ 102(e) Date: Feb. 3, 1992

[87] PCT Pub. No.: WO90/15300

PCT Pub. Date: Dec. 13, 1990

[30] Foreign Application Priority Data

Jun. 1, 1989 [SE] Sweden ..... 8901976

[51] Int. Cl.[5] ..... F41A 9/44

[52] U.S. Cl. ..... 89/47

[58] Field of Search ..... 89/45, 46, 47

[56] References Cited

U.S. PATENT DOCUMENTS 2,785,607 3/1957 Henstrom et al. ..... 89/45

*Primary Examiner*—Stephen C. Bentley

*Attorney, Agent, or Firm*—Pollock, Vande Sande & Priddy

[57] ABSTRACT

Rammer for those artillery pieces which are charged with a shell and propellant separately, intended to move the shell, upon charging the piece, from a charge position in the immediate vicinity of the charge opening of the piece to the rammed position of the shell inside the barrel ahead of the charge space intended for the propellant powder charge. The rammer, which preferably is hydraulically operated, is divided into two piston cylinder systems consisting of a primary rammer and a secondary rammer connected by means of a transverse arm and designed with parallel but counter-directed projection directions. Immediately before the rammer is activated, the secondary rammer is situated along the longitudinal axis of the barrel and with its own piston rod completely retracted immediately behind the shell situated in the charge piston, while the primary rammer is at the same time completely projected. Upon ramming, the primary rammer is drawn in and the secondary rammer is pushed out. The invention also includes a swivel function which makes it possible to move the rammer aside from its active position behind the piece to a rest position at the side of the piece.

7 Claims, 3 Drawing Sheets

RAMMER

FIELD OF THE INVENTION

The present invention relates to a rammer for artillery pieces which are separately charged with a shell and propellant charge.

BACKGROUND OF THE INVENTION

The purpose of the rammer is to drive the shell, upon charging of the piece, into its rammed position in the barrel, with at least one of the bourrelets of the shell in such close contact with the lands of the barrel rifling that the shell remains in the rammed position even at the maximum elevation of the piece. This is necessary in order to permit introduction of the propellant powder charge into its position in the charge space situated behind the rammed shell. The normal charging procedure begins by being the shell into the immediate vicinity of the open rear section of the artillery piece, for example on an in-swinging charge cradle, after which a rammer of one type or another drives the shell into its rammed position. Since, as has already been mentioned, there must be space behind the shell for the propellant powder charge itself, the distance by which the rammer must move the shell into the barrel is relatively long.

Moreover, the shell must be driven in with a certain force in order for it to remain there even when the piece is at its maximum elevation. In the case of purely axially displaceable rammers, this results in comparatively long constructions. On the other hand the known more compact rammer constructions have had to rely on a relatively long so-called free flight for the shell, which means that it makes contact with the rammer only during a relatively short part of the ramming distance from the charge position to the rammed position, but that the shell during this relatively short part of the ramming distance is given a sufficient speed so that, after the contact with the rammer has ceased, it can continue, by means of a combination of the acquired speed and the intrinsic gravity, into its rammed position with sufficient force to give the desired engagement in the barrel grooving.

An example of such a rammer with a long free flight for the shell is described in German Offenlegungsschrift 3,607,006. However, a long free flight constitutes a factor of unreliability, since in this case there is poor control of how good the ramming actually is in each particular case.

The purpose of the present invention is primarily to provide a rammer with a short free flight and a very compact construction. In addition, the construction of the rammer according to the invention includes a small number of simple and strong components.

Furthermore, the construction according to the invention has made it possible, in the case of hydraulic operation of the rammer, to limit the number of hydraulic connections to a minimum, and at the same time, due to the special design of the rammer, these connections can be made in the form of fixed connections on the breech casing of the piece, which therefore do not participate in the recoil of the piece, which is also very advantageous as regards both operational reliability and servicing requirements.

These advantageous characteristics of the rammer according to the present invention come fully into play in connection with modernizing older types of armored-turret-protected pieces which were originally charge manually, of which there are a very large number dating from the sixties and the beginning of the seventies and whose value would be increased to a very great extent if they could be provided with wholly automatic or semi-automatic charging systems instead of their previous manually charging systems. Since these pieces are already mounted in armored turrets with limited internal space, the requirement for compact charging systems is very significant. In addition, it must be possible to mount the charging system with place without significant interference in the artillery piece system as such or its possible auxiliary systems.

The rammer according to the present invention is thus primarily intended for those artillery pieces which are separately charged with the shell and propellant powder charges (powder bags). Upon charging of the piece, the rammer will move the shells from a charging position wholly or partly outside the rear charge opening of the piece to the rammed position of the shell ahead of the charge space intended for the propellant powder in the rear section of the barrel. As has already been mentioned, this displacement is at present relatively long and will probably be longer in future, since in recent times shells continue to become longer and narrower in line with the increase in the firing ranges of artillery pieces. Regarding the requirement for driving the shells at a certain force into the rammed position so that they remain there even when the piece is at its maximum elevation, it should be mentioned that the armored-turret-protected pieces are often of the howitzer type and have a maximum elevation of 75°–80° relative to the ground level.

The shells are brought to the charging position immediately outside the rear charge opening of the barrel either on an in-swinging charge cradle, usually provided with special securing members for the shells, or else the shells are placed manually in the charging position. With an appropriate design of the suspension of the charge cradle, the latter can be made to swing the shell at least partly into the charge opening of the piece. This of course facilitates the ramming.

The rammer according to the present invention, like most other rammers, is designed to grip behind the shell and push it forwards from the charge cradle to the rammed position of the shell inside the barrel. As has already been pointed out, the shortest possible free flight for the shell is desired here. The inventors have now succeeded in achieving a maximum ram travel for the rammer according to the invention within a minimum space requirement by dividing the rammer into two piston cylinder systems which are connected to each other by means of a transverse arm and are axially displaceable parallel to each other and to the barrel from and to their respective zero positions. These piston cylinder systems define a primary and secondary rammer whose combined ram travel corresponds to the distance which the rammer is to move the shell, and the cylinder of the primary rammer is arranged non-displaceable relative to the breech casing of the piece, while the transverse arm is connected to the displaceable piston rod of the primary rammer, and the cylinder of the secondary rammer is securely connected to the other end of the transverse arm. Moreover, the projection direction of the primary rammer piston is directed rearwards along the barrel of the piece and identical to the retraction direction of the secondary rammer piston. This means that the projection direction of the secondary rammer piston is directed forwards in the barrel direction. The two cooperating rammers are moreover mounted on the piece in such a way that, when the primary rammer is completely projected and the secondary rammer completely retracted, the front part of the secondary rammer, that is to say the front part of its piston rod, is immediately behind a shell situated on the charge cradle or the like. With this design of the rammer, the ramming is effected by means of a combination of projection of the secondary rammer and retraction of the primary rammer.

According to this invention, the rammer is additionally designed in such a way that, as long as it does not extend into the charge space of the barrel, it can be swivelled aside about the attachment of the transverse arm on the primary rammer, so that the secondary rammer is completely turned away parallel to the side of the barrel axis, that is to say away from the rear charge opening of the barrel.

By means of retraction of the primary rammer piston, the whole rammer can thus be transferred to a rest position alongside the barrel.

The possibility of moving the secondary rammer to the side is also used with advantage after ramming in order to facilitate the swinging-in of the charge cradle with a new shell. This possibility also means that, upon firing, no separate space for the rammer is required behind the piece upon recoil of the latter.

The rammer according to the invention has been defined more closely in the subsequent patent claims and will now be described in somewhat greater detail together with the exemplary embodiment shown in the attached drawings, wherein:

DETAILED DESCRIPTION OF THE PREFERRED EMBODIMENT(S)

Figure 1:
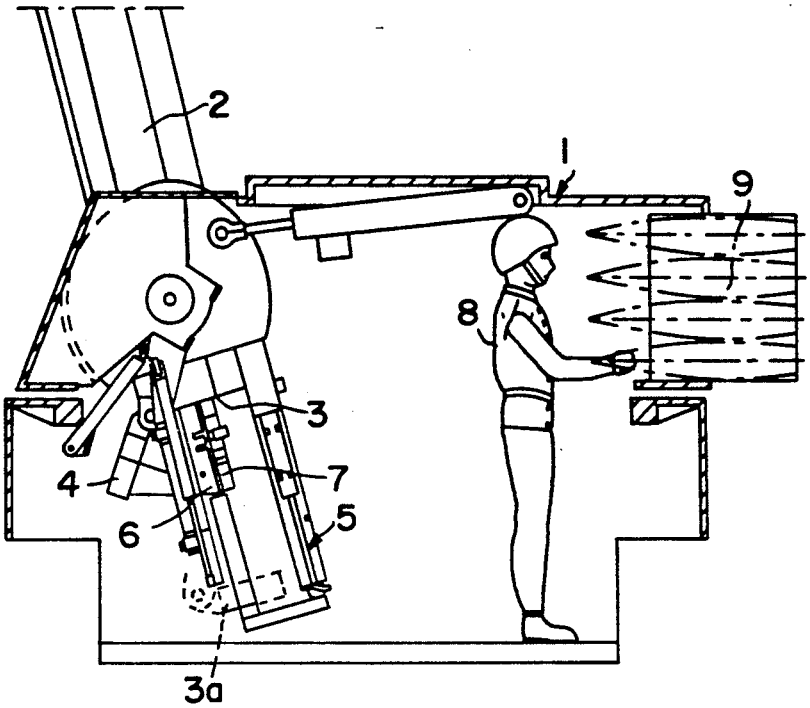
FIG. 1 shows a section through an armored turret with a mounted artillery piece of high elevation and provided with the rammer according to the present invention.

The armoured turret 1 shown in FIG. 1, which can be part of, for example, a track-laying vehicle such as a CATERPILLAR ®-tracked armored howitzer, comprises a howitzer 2 whose rear section ends at 3 but, upon recoil, drops down to the position as indicated 3*a*. The breech screw, open in the drawing, is indicated by 4. A rammer 5, a charge cradle 6 and finally a shell 7, which is about to be rammed, can also be seen in FIG. 1. For further details regarding the design of the charge cradle and the rammer, reference will be made to the other figures. FIG. 1 also shows a charger 8 whose task is to ensure that the correct shell from the shell stock 9 is placed on the charge cradle 6. In the case shown, it is assumed that the charger 8 positions the shells manually on the charge cradle 6, which is then swung in for ramming of the shell. However, the transfer of the shells to the charge cradle can also be automated, but is not relevant the present invention and for this reason is not discussed here.

As far as possible, corresponding components have been given the same reference designations in the various figures.

Figures 2, 3, 6A, 6B, 6C, 6D, 6E:
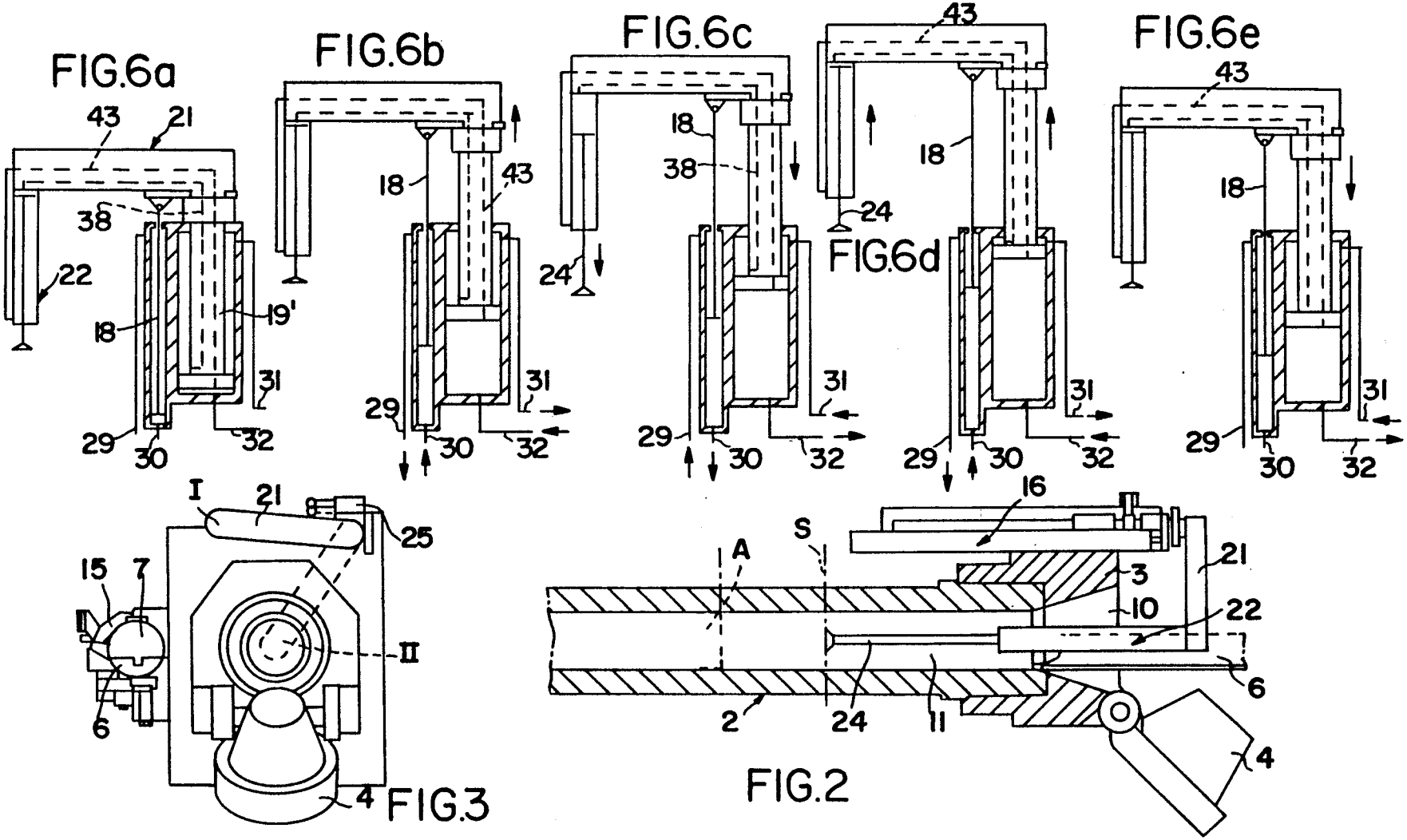
FIG. 2 shows a section through the rear part of a barrel provided with the rammer according to the present invention in its foremost position (rammed position)
FIG. 3 shows the same piece as in FIG. 2 as seen from the rear, but at the time immediately before the charge cradle has been swung into position behind the barrel.
FIGS. 6*a–e* show the principles of the rammer functions (for the sake of clarity the swivel function has been omitted in these figures).
Figure 4:
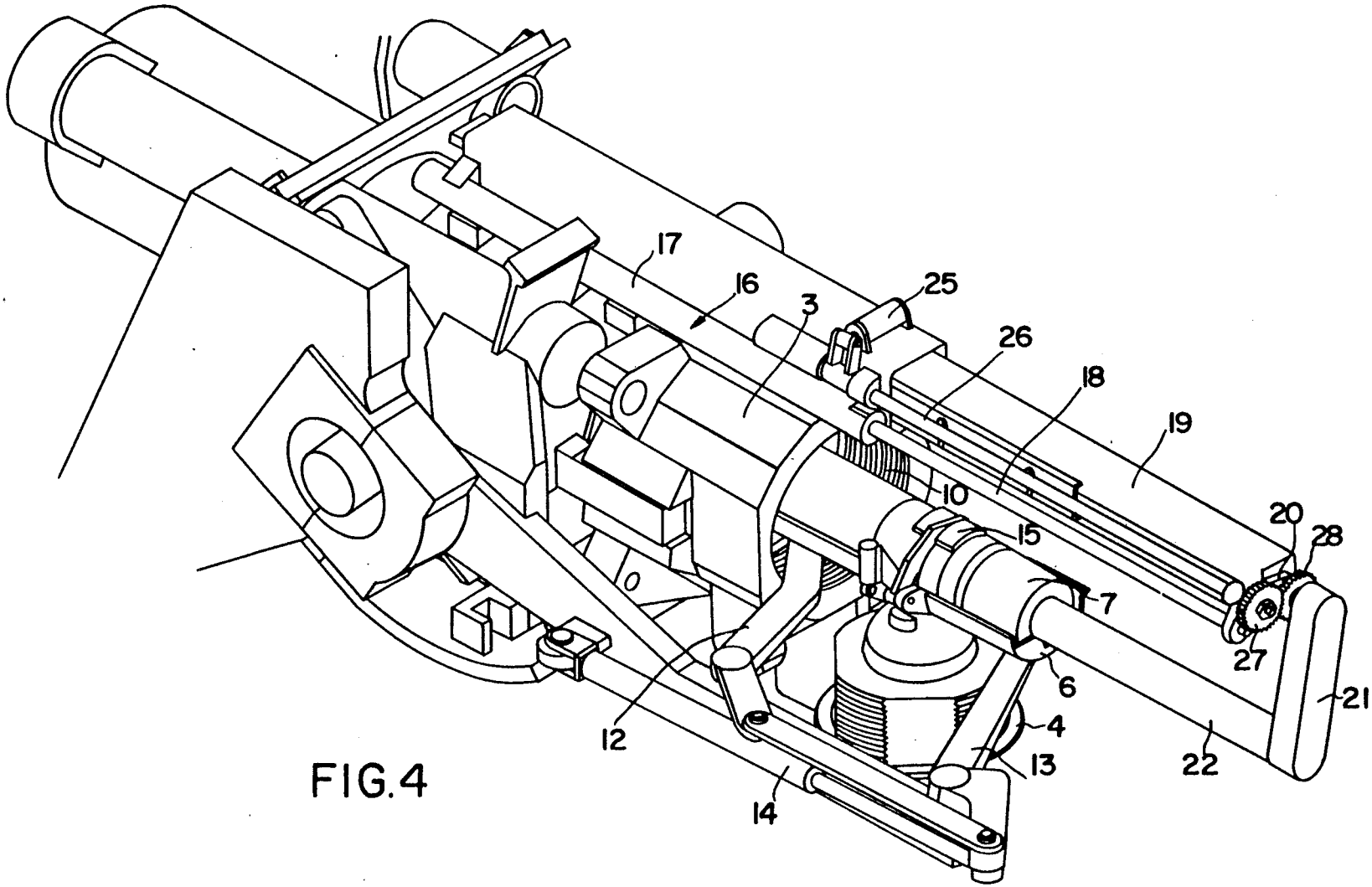
FIG. 4 shows a perspective more detailed view of the rear part of an artillery piece provided with the rammer according to the invention, where the ramming has just begun.

FIGS. 2 to 4 show more details than in FIG. 1, but in FIG. 4 also the rear section of the piece is referred to by 3, and the breech screw 4 is secured on the latter.

In front of the open breech screw 4 lies the charge opening 10 of the piece, and in front of this the charge space 11 intended for the propellant powder charge (see FIG. 2). The charge cradle 6 (see FIG. 4) is suspended on swinging arms 12 and 13 and is maneuvered by means of the hydraulic cylinder 14. For holding the shell 7 on the charge cradle right up to ramming, there is also provided a hydraulically operated holding device 15.

The rammer 5 includes of a primary rammer 16 consisting of a hydraulic cylinder 17, in this case fixed on the topside of the breech casing, and a piston rod 18 which can project in the rearwards direction of the piece parallel to the extent of the barrel. Moreover, parallel to the primary rammer and maneuvered by the latter, is an axially displaceable guide beam 19. This in turn contains an oil reserve for the hydraulic system. The design of the latter will be discussed in greater detail in conjunction with FIGS. 5 and 6*a–e*. At the common end section 20 of the guide beam 19 and the primary rammer piston, a transverse arm 21 is secured in such a way as to be able to swivel around, and secured at the other end of the transverse arm is the cylinder 23 of a secondary rammer 22. The piston rod of the latter has the reference 24. The piston rod of the secondary rammer projects into the barrel 2.

In order for the rammer to be moved aside from the charge opening 10, there is a swivel function consisting of a hydraulic cylinder 25 which acts on a spline shaft 26 on which a gearwheel 27 is connected in non-rotational manner. When the gearwheel 27 is turned, this in turn acts on a second gearwheel 28 which is connected securely to the transverse arm 21, which is then swivelled around. As shown, for example, FIG. 3, the secondary rammer can in this way be moved between the two positions I and II shown in the figure, where position I is a rest position and position II is a ramming position.

As further seen from FIG. 2, the secondary rammer, upon maximum protection and when combined with a completely retracted primary rammer, reaches the end position S. The rammed position A of the shell is also indicated in the figure with broken lines. Between positions S and A there is a relatively short free flight distance which the shell crosses as a result of the speed which has been imparted to it before it reaches the end point S for the advance of the rammer.

The ramming is thus effected in the following manner:

The shell 7 is placed by the charger 8 in the charge cradle 6. Assuming that the charge opening 10 is now open, due to the fact that the breech screw 4 has been moved aside, then the charge cradle 6 can be swung into the mouth of the charge opening 10 with the aid of the piston 14. The next step is to activate the rammer 5 situated in the rest position I, in which the primary rammer 16 has first been moved to its fully projected rear position, and then the transverse arm 21 with the secondary rammer 22 is swung to position II by means of the piston 25, the shaft 26 and the gearwheels 27 and 28. When the secondary rammer 22 has reached position II, the outer end of this rammer is situated immediately behind the rear end of the shell 7. The ramming is activated in this position, and at the same time the retention member 15 is released. Upon ramming, the primary rammer will be drawn into the fully retracted position and the secondary rammer will be pushed out completely. These two actions are either effected consecutively or, more preferably, to some extent simultaneously, since the velocities are then added. The best result is achieved if the primary rammer, which expediently has the longest ram travel, is initiated first and is driven alone a first distance at relatively low velocity, and only then is the secondary rammer initiated and driven parallel to the primary rammer. The velocities of the rammers are thus added together during the final part of the ramming of the shell, as a result of which the necessary ramming velocity is obtained. When the outer end of the secondary rammer 22 has reached position S, the shell 7 will have acquired a velocity sufficient for the shell to cross the distance A-S under its own force and to have a sufficient kinetic energy, when it reaches A, to secure the shell against the lands of the grooves in the rammed position ahead of A.

Regarding the charging operation, it only remains now, after the charge cradle has been swung aside, to introduce the propellant powder into the charge space 11 behind the shell and to close the breech screw.

The principles of the hydraulic system will now be described in greater detail in combination with FIGS. 5 and 6*a–e*.

Figure 5:
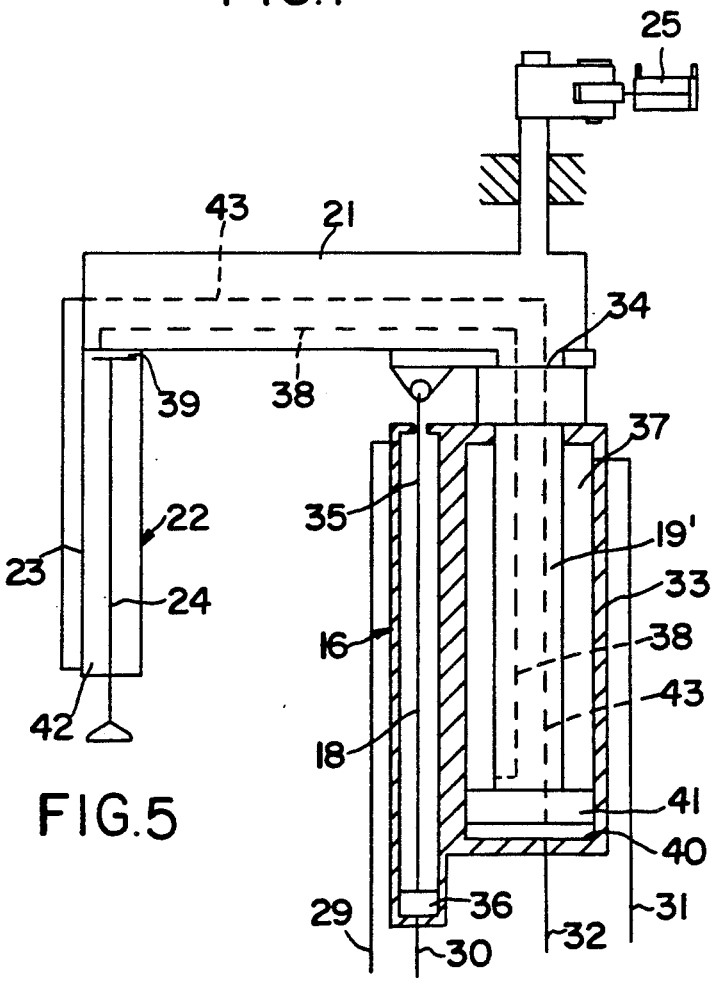
FIG. 5 shows the principle of the rammer.

These figures correspond except for the different scale and for the fact that the swivel function has been omitted in FIGS. 6*a–e* for the sake of clarity. The main parts have the same references as in the other figures, although we have been sparing in our use of these in FIGS. 6*a–e*. The swivel function, as it appears in FIGS. 5, is somewhat simplified compared to the other figures.

As can be seen from the figures, the cylinder 17 of the primary rammer 16 constitutes an integral unit with the guide beam 19 and its built-in oil reserve. Apart from the swivel cylinder 25, which has its own connections for the hydraulic oil, there are four connections 29–32 for controlling the various functions of the rammer. All these connections are located on those parts of the primary rammer and guide beam which are stationary relative to the breech casing of the piece. The guide beam 19 in FIG. 4 corresponds in functional terms in the outline sketches in FIGS. 5 and 6*a–e* to the piston rod 19', which differs slightly in appearance but not in terms of function from the other figures. The piston rod 19' is displaceably mounted in the cylinder 33, which constitutes the oil reserve referred to earlier in the text. The cylinder 33 is built integral with the cylinder 16 of the primary rammer. Since the part 16–33 is fixed, the connections 29–32 can also be made fixed, which is extremely advantageous with regard to design, servicing and operating.

The displaceable piston rod 18 of the primary rammer corresponds entirely to the other figures.

The swivel function is shown here diagrammatically at 34, while the transverse arm 21 and the secondary rammer 22 corresponds entirely in terms of concept with the other figures.

Of the hydraulic oil connections, 29 leads to the return side 35 of the primary rammer and 30 leads to its projection side 36, while 31 opens into one side 37 of the reserve oil supply and reaches from there, via a line 38 through the piston rod 19' and the transverse arm 21, to the projection side 39 of the secondary rammer 22, while the connection 32 opens into the other side 40 of the piston 41 on the piston rod 19'. The piston 41 divides this part of the oil supply from its other side 37. From the space 40, the connection 32 leads to the return side 42 of the secondary rammer via a second channel 43 which likewise passes through the transverse arm 21 and opens out at the return side 42 of the secondary rammer.

In FIGS. 6*a–e*, 6*a* indicates the zero position at position I, and 6*b* indicates the projection of the primary rammer, after which swivelling to ramming position II takes place, while FIG. 6*c* shows an initiated ramming, FIG. 6*d* shows the returned rammer just before swivelling back to position I, and FIG. 6*e* shows the retraction of the primary rammer.

Starting with FIG. 6*a*, which shows the zero position, the function for activating the rammer (see FIG. 6*b*) now involves applying a pressure to the connection 30, at the same time as a draining is effected via the connection 29. At the same time, a draining is effected at 31 and a filling at 32. At the same time, hydraulic oil is forced via the channel 43 to the return side of the secondary rammer 22.

When the primary rammer has reached its outermost position, the rammer is swivelled back from position I to position II. This thus takes place between FIGS. 6*b* and 6*c*.

For activation of the rammer function, a pressure is applied at 29, which draws in the primary rammer, which thus requires drainage via 30. If a pressure is applied at the same time at 31, the secondary rammer is activated via the channel 38, provided that a draining is effected via 32. This is shown principally in FIG. 6*c*.

After the ramming, the secondary rammer is to be drawn in and the primary rammer pushed out in order for the whole rammer to be moved away to its rest position. The two first-mentioned movements are initiated more or less simultaneously by applying a pressure at 30 and 32 and draining via 29 and 31. The hydraulic fluid pressure from 32 reaches the return side of the secondary rammer via the channel 43. FIG. 6*d* shows the end position of these movement.

Between FIGS. 6*d* and 6*e* the rammer is swung aside to the rest position (I) with the secondary rammer at the side of the barrel, after which the primary rammer is again drawn in, which is shown in FIG. 6*e*, while the secondary rammer is held back in its zero position. Here, pressure is applied at 29, drainage is effected via 30 and 32 and filling via 31.

The invention is not limited to the exemplary embodiment discussed above, but instead can be modified within the inventive concept as defined in the patent claims.

We claim:

1. A rammer for use with an artillery piece having a rifled barrel with a breech casing which is separately charged with a shell and a propellant, said rammer adapted to charge said shell into said barrel from a charge cradle which is positioned adjacent a charge opening in said barrel and to drive said shell into a rammed position in a charge space provided in said barrel for said propellant and in contact with rifling in said barrel;

said rammer comprising primary and secondary piston-cylinder systems having pistons which are axially disposed parallel to each other and to said barrel, and a transverse arm member having first and second end portions connecting said piston-cylinder systems together so that their combined travel corresponds to the distance by which said rammer will move said shell, the cylinder of said primary piston-cylinder system being fixed relative to said breech casing and the piston thereof being connected to said first end portion of said transverse arm member, and directed rearwardly along the rear section of the barrel, and the cylinder of said secondary piston-cylinder system being securely connected to said second end portion of said transverse arm member, the piston thereof having its direction of rammer movement oriented toward said charge space so that when the piston of the primary piston-cylinder is in a fully projected position and the piston of the secondary piston-cylinder is in a completely retracted position, said piston of said secondary piston cylinder is adapted to be positioned inwardly behind a shell lying on said charge cradle.

2. A rammer according to claim 1 wherein said transverse arm member and the cylinder of the secondary piston-cylinder system secured thereto is adapted for swiveling from a first rest position where said cylinder of said secondary system lies beside the barrel to a second activation position where the axis of the secondary system coincides with the axis of the barrel.

3. A rammer according to claim 1 including a hydraulic control system for maneuvering the components of the piston-cylinder system.

4. A rammer according to claim 3 including a hydraulic cylinder for swiveling said transverse arm.

5. A rammer according to claim 1 wherein the piston of said primary piston-cylinder system has a longer travel path than the piston of the secondary piston-cylinder system.

6. A rammer according to claim 2 including a guide beam on which said transverse arm is rotatably mounted, and means interconnecting said guide beam with said primary piston-cylinder system for moving said guide beam.

7. A rammer according to claim 6 wherein said rammer includes a hydraulic control system and means are provided in said guide beam for containing an oil supply for said hydraulic system.

* * * * *